US005341705A

United States Patent [19]

Lin

[11] Patent Number: 5,341,705

[45] Date of Patent: Aug. 30, 1994

[54] ASSEMBLY SCREW DRIVER

[76] Inventor: Ming-Chen Lin, 5, Lane 1072, Min Tsu I Road, Tso Ying District, Kaohsiung, Taiwan

[21] Appl. No.: 59,259

[22] Filed: May 10, 1993

[51] Int. Cl.[5] ..... B25B 15/02

[52] U.S. Cl. ..... 81/438; 81/439

[58] Field of Search ..... 81/438, 439

[56] References Cited

U.S. PATENT DOCUMENTS 3,742,787 7/1973 Whiteford ..... 87/438 X
4,404,874 9/1983 Lieser ..... 81/438
4,535,658 8/1985 Morinari ..... 81/438 X
4,776,246 10/1988 Elliston ..... 81/438 X

*Primary Examiner*—James G. Smith

[57] ABSTRACT

An assembly screw driver having a handle with a through hole connecting the front end and rear end of the handle; the through hole has a support device fixed therein near the front end of the handle to support and secure the base of the body of the screw driver. The body and the handle of the screw driver are detachable and the base of the body may be inserted via the rear end of the handle along the through hole to engage with the support device so that the body may be concealed in the handle.

7 Claims, 3 Drawing Sheets

ASSEMBLY SCREW DRIVER

BACKGROUND OF THE INVENTION

1. Field of the Invention

The present invention relates generally to an assembly screw driver structure, and in particular a structure wherein the body of the screw driver may be concealed in the handle.

2. Description of the Prior Art

Conventional screw drivers comprise a handle and a body having its base secured to the front end of the handle. The front end of the body is the application end which is generally flat or cross shaped.

In order that the screw driver may be used with various kinds of screws, there is also a kind of assembly screw driver which includes the following two typical constructions:

The first kind is as shown in FIG. 1, in which the handle and the body are detachable so that the overall length of the screw driver is shortened when they are detached from each other. Generally speaking, this kind of screw driver construction has a number of bodies with different application ends, such as a flat or a cross application end. When in use, a body with a suitable application end is selected and the base of the body is assembled to the front end of the handle. This kind of assembly screw driver is already very common, and the manner of assembly is by means of a screw assembly device provided at the front end of the handle.

In the other kind of screw driver, the handle is fixedly attached to the body, but the front end of the body is an internal hexagonal sleeve for accommodating various kinds of short application heads, which consist of a base and an application end connected thereto. Certainly, each application head has a different application end.

The first kind of assembly screw driver described above can save storage space, but the cost of the various bodies for matching the handle is comparatively less economical than the second screw driver structure.

If one body is to match one handle, the first kind of screw driver structure has the advantage of easy storage since the handle and the body can be taken apart; however, the body may be easily lost after it is detached from the handle. In the second kind of screw driver, the space saved is very limited. Additionally, both structures have a common drawback, i.e., these kinds of assembly screw drivers cannot be used in a narrow space not wide enough to accommodate the overall length of the screw driver after assembly.

SUMMARY OF THE INVENTION

Therefore, the primary object of the present invention is to provide an assembly screw driver, wherein the body of the screw driver may be concealed in the handle.

Another object of the present invention is to provide an assembly screw driver which may be used in a space too narrow for conventional screw drivers.

According to the present invention, the middle of the handle of the screw driver is provided with a through hole connecting the front end and the rear end of the handle, and in the front part of the through hole is disposed a bidirectional support device; the body of the screw driver and the handle may be disassembled so that the base of the body may be inserted, via the front end or the rear end of the handle, into the through hole to engage with the support device, wherein if the body is inserted via the rear end of the handle, the body may be concealed in the handle.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENTS

Figure 1:
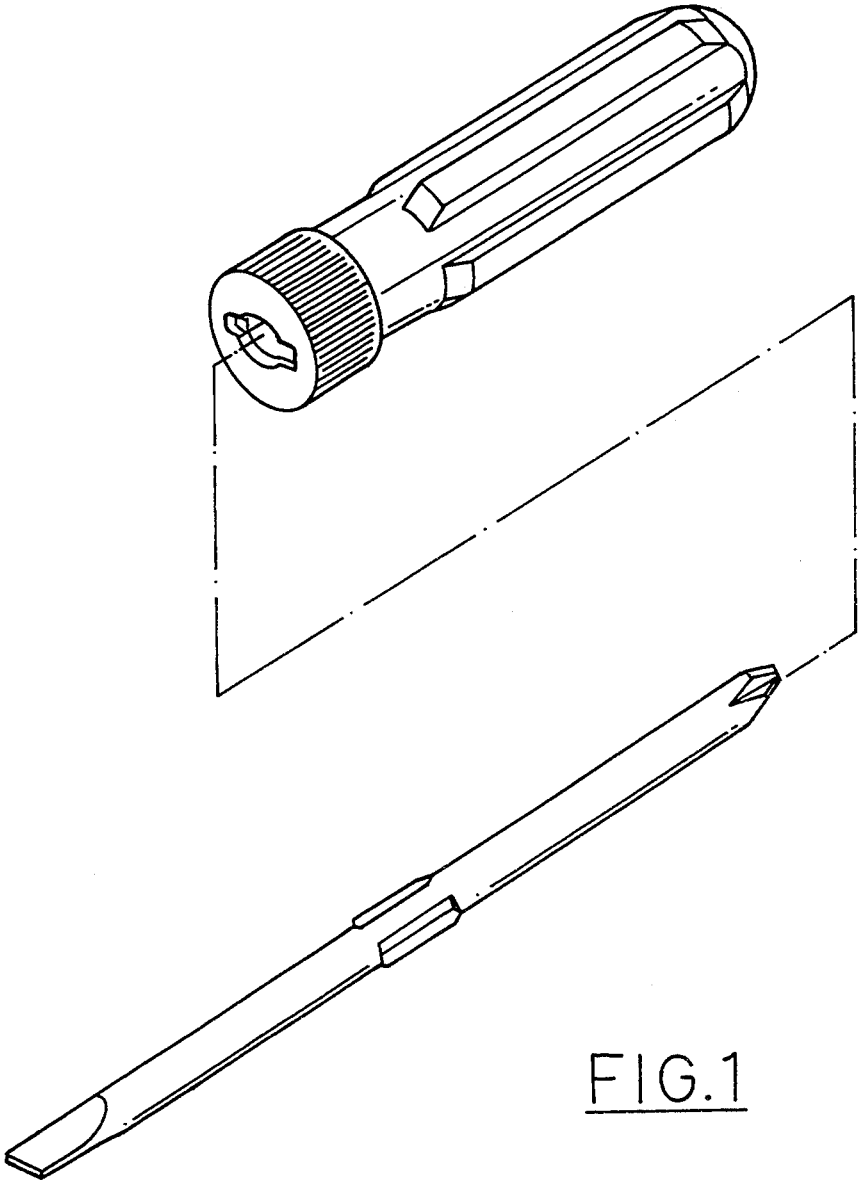
FIG.1 PRIOR ART
FIG. 1 is a perspective exploded view of the conventional screw driver structure.

As shown in FIGS. 2 to 8, the present invention comprises a handle 1 and a screw driver body 2. The handle 1 has a front end 11 and a rear end 12, and a through hole 13 connecting the front end 11 and the rear end 12. The body 2 also has a front end 21 and a rear end 22, the rear end 22 being connected to a base 23; the greatest outside diameter of the body 2 is smaller than the inside diameter of the through hole 13 of the handle 1.

The present invention is characterized in that the base 23 of the body 2 has a push bar 231 and an angular portion 232 connected thereto, and a shoulder 233 is formed at the joint of the push bar 231 and the angular portion 232.

The present invention is further characterized in that a tubular support device 3 is fixed within the through hole 13 adjacent to the front end 11 of the handle 1, the central part of the support device 3 being a chamber 31 which extends forwardly in the direction of the front end 11 of the handle 1 to connect with a front sleeve portion which comprises a front internal angular portion and a front clamp portion; the chamber 31 further extends rearwardly in the direction of the rear end 12 of the handle 1 to connect with a rear sleeve portion which comprises a rear internal angular portion and a rear clamp portion. In the embodiment shown in FIG. 3, the chamber 31 extends forwardly in the direction of the front end 11 of the handle 1 to connect with the front internal angular portion 32 (please refer to FIG. 5), forming a front shoulder 33 (see FIG. 3) at the joint of the front internal angular portion 32 and the chamber 31. The internal angular portion 32 further extends in the direction of the front end 11 of the handle 1 to connect with a front clamp portion 34. Correspondingly, the chamber 31 extends rearwardly in the direction of the rear end 12 of the handle 1 to connect with a rear internal angular portion 35, forming a rear shoulder 36 at the joint of the rear internal angular portion 35 and the chamber 31, and the rear internal angular portion 35 further extends in the direction of the rear end 12 of the handle 1 to connect with a rear clamp portion 37.

Figure 2:
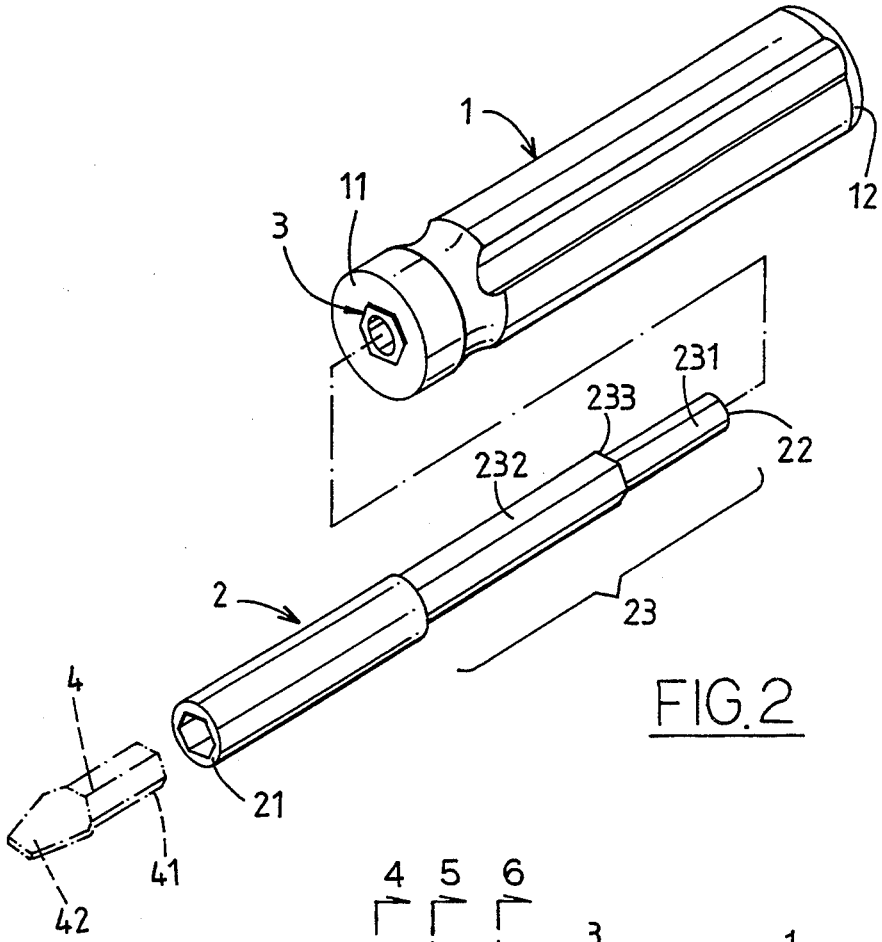
FIG. 2 is a perspective exploded view of the first preferred embodiment of the present invention.
Figure 8:
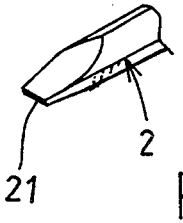
FIG. 8 is a perspective view of the second preferred embodiment of the front end of the body of the screw driver according to the present invention.
Figure 9:
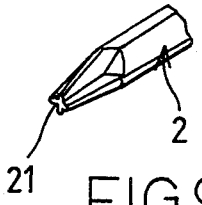
FIG. 9 is similar to FIG. 8, but showing the third preferred embodiment.
Figure 10:
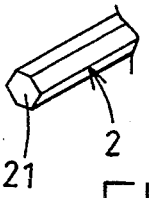
FIG. 10 is similar to FIG. 8, but showing the fourth preferred embodiment.

The above-mentioned chamber 31 has an inside diameter greater than the outside diameter of the push bar 231 of the body 2 so that the push bar 231 can pass through the chamber 31. The angular portion 232 of the body 2 may be formed in any angular structure, but preferably a regular quadrilateral or hexagonal structure. Correspondingly, the internal angular portion 32 or the rear internal angular portion 35 of the support device 3 in the handle 1 should match the angular portion 232 of the body 2 so that the angular portion 232 of the body 2 can be inserted into the through hole 13 of the handle 1 through the front end 11 (as in FIG. 7) or the rear end 12 (as in FIG. 3), so that after being inserted into the rear internal angular portion 35 or the front internal angular portion 32, the angular portion 232 of the body 2 may not turn again. In this way, when the handle 1 is caused to turn, the body 2 inserted into the handle 1 may also turn therewith. The front end 21 of the body 2 may be an internal hexagonal sleeve as shown in FIG. 2, or a flat application end as shown in FIG. 8, or a cross application end as shown in FIG. 9, or an external hexagonal post as shown in FIG. 11. Certainly, in addition to these shapes, it may also be formed in other suitable shapes; the preferred embodiment .is the internal hexagonal sleeve structure shown in FIG. 2, because such a configuration allows direct application to nuts and may also be used with a very short application head 4 as shown by imaginary lines. The application head 4 is generally formed of a short hexagonal post so that its base 41 may fit in the internal hexagonal sleeve of the body 2, and the front end 42 thereof may form into application heads of various shapes according to the type of work.

The front clamp portion 34 and the rear clamp portion 37 of the above-mentioned support device 3 in the handle 1 may have various possible configurations, as long as each of which can grip the angular portion 232 of the body 2. Preferred embodiments are shown in FIGS. 3 and 4, wherein the front clamp portion 34 and the rear clamp portion 37 are each provided with a groove 341 and 371 for the insertion of an open elastic coil 38 which has an inside diameter slightly smaller than the greatest outside diameter of the angular portion 232 of the body 2 so that when the body 2 is inserted into the handle 1, it may not easily slip out.

Figure 7:
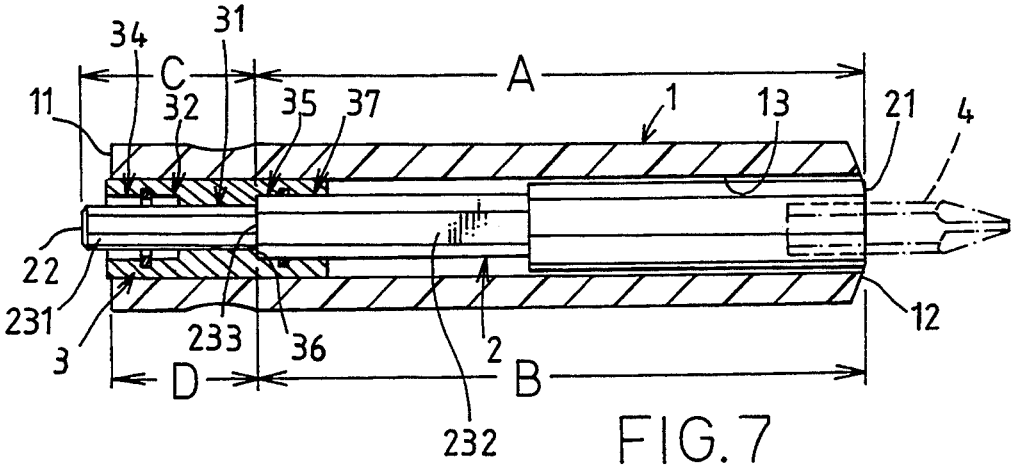
FIG. 7 is an assembled sectional view of the first preferred embodiment of the present invention, showing the body of the screw driver inserted through the front end of the handle.

A further feature of the present invention is as shown in FIG. 7. The distance A from the front end 21 of the body 2 to the shoulder 233 thereof is equivalent to the distance B from the rear end 12 of the handle 1 to the rear shoulder 36 of the support device 3, so that the front half portion of the body 2 may be completely concealed within the handle 1. As for the distance C from the rear end 22 of the body 2 to the shoulder 233 thereof, it is preferably greater than the distance D from the front end 11 of the handle 1 to the rear shoulder 36 of the support device 3 so that the push bar 231 of the body 2 sticks out from the handle 1 in order that when a force is applied to the rear end 22 of the body 2, the body 2 may be pushed to project from the handle 1.

Figure 3:
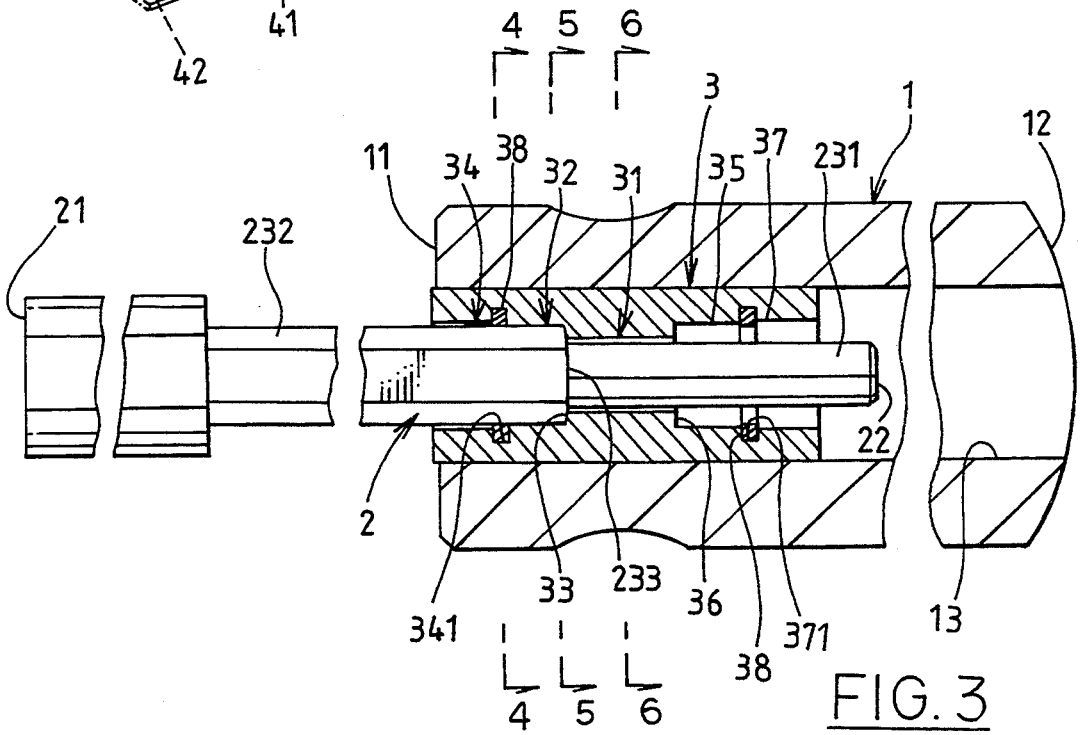
FIG. 3 is an assembled sectional view of the first preferred embodiment of the present invention, showing the body of the screw driver inserted through the rear end of the handle.
Figure 4:
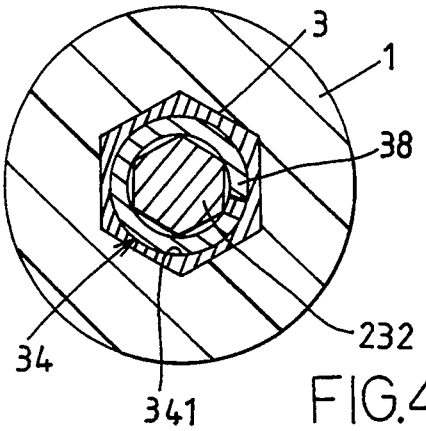
FIG. 4 is a sectional view taken along line 4—4 of FIG. 3.
Figure 5:
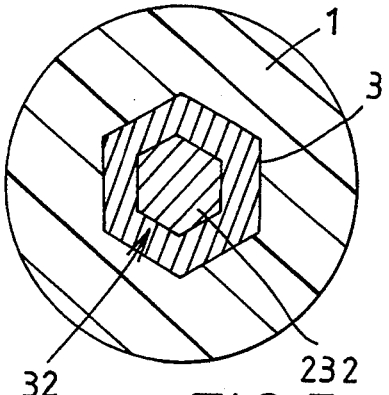
FIG. 5 is a sectional view taken along line 5—5 of FIG. 3.
Figure 6:
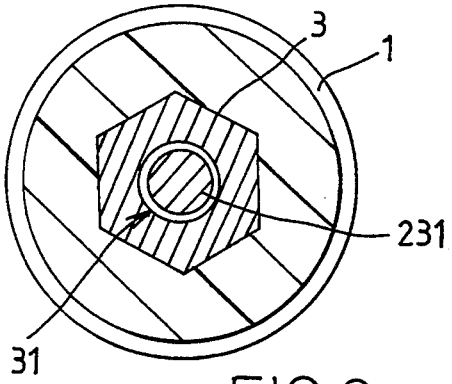
FIG. 6 is a sectional view taken along line 6—6 of FIG. 3.

Under normal circumstances, the body 2 may be removed from the handle 1, and the base 23 of the body 2 may be inserted into the front end 11 of the handle as shown in FIGS. 2 and 3, so that the shoulder 233 of the body 2 lies close to the front shoulder 33 of the support device in the handle 1, and the front clamp portion 34 secures the angular portion 232 of the body 2 to form a screw driver. Under special circumstances, for instance, in a space too narrow for the normal length of the conventional screw drivers, the body 2 with an internal hexagonal sleeve at the front end thereof may be inserted into the handle 1 through the rear end 12 of the handle 1, as shown in FIG. 7. Since the angular portion 232 of the body 2 is fixedly inserted in the rear internal angular portion 35 of the support device 3 within the handle 1, the application head 4 may be inserted into the internal hexagonal sleeve as shown in FIG. 3 and a force is applied to the handle 1 to cause the working head 4 to turn and work.

As described above, the assembly screw driver according to the present invention occupies little space and can be used in a narrow working space, and the body of the screw driver will not be lost easily. It is, therefore, a very practical tool. The above-described embodiments are to illustrate the feasibility of the present invention; those skilled in the art may, of course, make some modifications based on the above embodiments; but it should be understood that such modifications are within the scope of the appended claims. For instance, the configuration of the support device inside the handle may be modified so that the chamber first connects to the front clamp portion then the front internal angular portion; or the chamber first connects to the rear clamp portion then the rear internal angular portion; the effects achieved are still the same. Therefore, although the present invention has been illustrated and described with reference to the preferred embodiments thereof, it should be understood that it is in no way limited to the details of such embodiments, but is capable of numerous modifications within the scope of the appended claims.

What is claimed is:

1. An assembly screw driver comprising:

a handle having a front end and a rear end, and a through hole connecting said front end and said rear end; and a body having a front end and a rear end, said rear end connecting to a base, the outside diameter of said body being smaller than the inside diameter of said through hole of said handle; wherein said base of said body has a push bar which is connected to an angular portion, forming a shoulder at the joint of said push bar and said angular portion; and a tubular support device is fixed inside said through hole near said front end of said handle, the middle portion of said support device being a chamber which extends forwardly in the direction of said front end to connect with a front sleeve portion which comprises a front internal angular portion and a front clamp portion, forming a front shoulder at the joint of said front sleeve portion and said chamber; said chamber further extends rearwardly in the direction of said rear end of said handle to connect with a rear sleeve portion which comprises a rear internal angular portion and a rear clamp portion, forming a rear shoulder at the joint of said rear sleeve portion and said chamber; the inside diameter of said chamber being greater than the outside diameter of said push bar of said body, the configuration of said front internal angular portion and said rear internal angular portion matching the shape of said angular portion of said body so that when said angular portion of said body is inserted into said front internal angular portion or said rear internal angular portion, no turning movement can be performed.

2. An assembly screw driver as claimed in claim 1, wherein said front end of said body is an internal hexagonal sleeve.

3. An assembly screw driver as claimed in claim 1, wherein said front end of said body is an external hexagonal sleeve.

4. An assembly screw driver as claimed in claim 1, wherein said front end of said body is a flat application end.

5. An assembly screw driver as claimed in claim 1, wherein said front end of said body is a cross application end.

6. An assembly screw driver as claimed in claim 1, wherein the distance from said front end of said body to said shoulder is equivalent to the distance from said rear end of said handle to said rear shoulder, and the distance from said rear end of said body to said shoulder is greater than the distance from said front end of said handle to said rear shoulder.

7. An assembly screw driver as claimed in claim 1, wherein said front clamp portion and said rear clamp portion are each provided with a groove in which is inserted an open elastic coil, the inside diameter of said open elastic coil being smaller than the greatest outside diameter of said angular portion of said body.

* * * * *